United States Patent [19]

Nowak

[11] 4,121,504

[45] Oct. 24, 1978

[54] CYLINDER POSITIONING SYSTEMS

[75] Inventor: Andrew Nowak, Portland, Oreg.

[73] Assignee: Inovec, Inc., Portland, Oreg.

[21] Appl. No.: 760,865

[22] Filed: Jan. 21, 1977

[51] Int. Cl.[2] ..... F01B 9/00; F15B 9/03; F15B 9/09; F01B 31/12

[52] U.S. Cl. ..... 92/137; 92/5 R; 91/363 R; 91/383

[58] Field of Search ..... 92/137, 5 R, 383, 363 R

[56] References Cited

U.S. PATENT DOCUMENTS

| | | | |
|---|---|---|---|
| 2,740,610 | 4/1956 | Gatti | 92/137 |
| 3,043,093 | 7/1962 | Stott | 92/137 |
| 3,160,836 | 12/1964 | Farley | 92/5 R |

*Primary Examiner*—Paul E. Maslousky
*Attorney, Agent, or Firm*—Klarquist, Sparkman, Campbell, Leigh, Hall & Whinston

[57] ABSTRACT

A linear positioning cylinder drive has a piston connected at one end to a load and at the other end to a cable. The cable is secured to a pulley secured to a shaft urged in a takeup direction by a coil spring or hydraulic motor. The piston is moved by a hydraulic pump through a servo valve actuated by a circuit controlled by a transducer driven by the shaft. In one embodiment, the transducer is rotary and in another embodiment the transducer is linear.

1 Claim, 9 Drawing Figures

CYLINDER POSITIONING SYSTEMS

DESCRIPTION

This invention relates to cylinder positioning systems, and has for an object thereof the provision of new and improved cylinder positioning systems.

Another object of the invention is to provide a cylinder positioning system wherein a hydraulically driven piston is connected by a cable and a pulley to a shaft driving an encoder to pulse a circuit controlling the hydraulic drive of the piston.

Another object of the invention is to provide a cylinder positioning system including a linear transducer.

A further object of the invention is to provide a simple, accurate setworks control.

Another object of the invention is to provide a cylinder positioning system wherein a servo valve controlling the drive of a positioning piston is controlled by a circuit responsive to pulses from an encoder driven by a pulley driven by a cable attached to the piston In the drawings.

Figure 7:
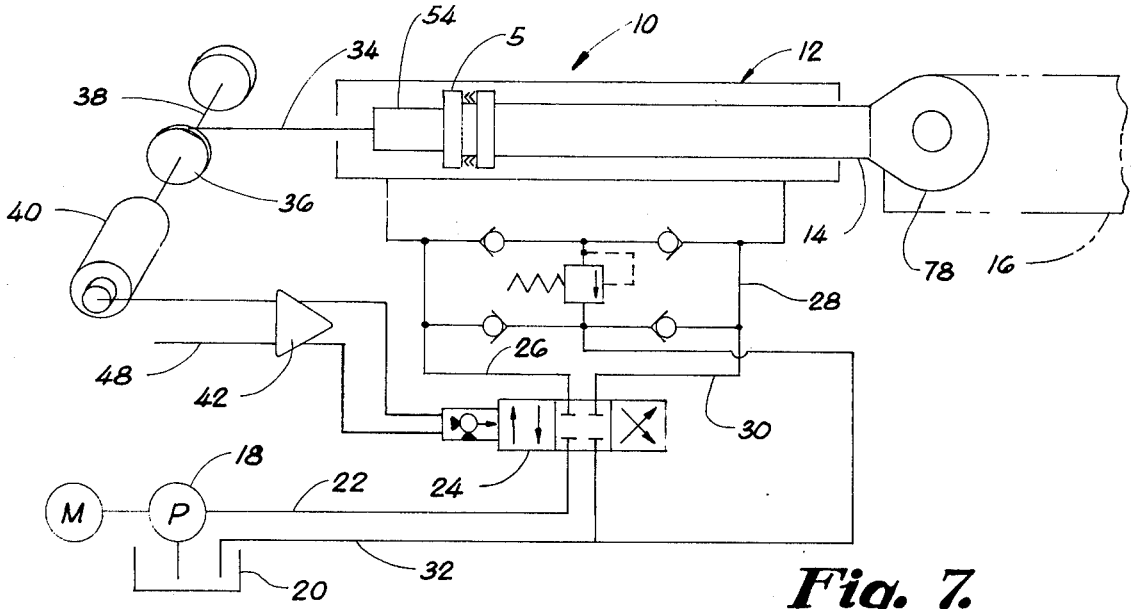
FIG. 7 is a schematic view of the system of FIG. 1.

A cylinder positioning system forming a specific embodiment of the invention includes cylinder drive 10 including a cylinder 12 and a double-acting piston 14 connected to a load 16, which, in the present instance, is a saw log positioning member of an edger infeed table, but may, of course, be a different type of positioned load. During operation to move the load 16 to the right (as viewed in FIG. 7) to a desired, precise position, hydraulic liquid is pumped by a pump 18 from a reservoir 20 through a supply line 22, a directional servo valve 24 and line 26 to the lefthand end of the cylinder and exhausted from the righthand end of the cylinder through a line 24, the servo valve 24 and exhaust lines 30 and 32 to the reservoir. As the piston is moved to the right, it pulls a cable 34 to turn a pulley 36 secured to a shaft 38. This turns the shaft to drive an encoder or rotary transducer 40, which, when the positioned load is almost at the precise position desired, triggers an electrical control circuit 42 to cause the servo valve 24 to move its closure member 46 to its centered position in which the feed to and exhaust from the cylinder of the hydraulic liquid are blocked. Then, after a cant carried by the infeed table is cut, a line 48 of a circuit (not shown) under the control of an operator or a computer, sets the circuit 42 to a condition such that the servo valve 24 is actuated either to again set the cylinder positioner to advance or retract the load to another precise set, as described above.

Figure 6:
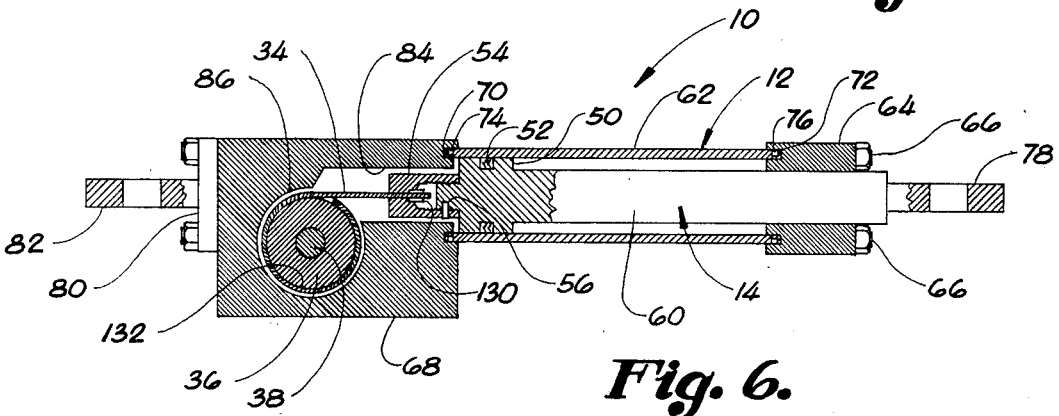
FIG. 6 is an enlarged, horizontal, sectional view taken along line 6—6 of FIG. 1.
Figure 5:
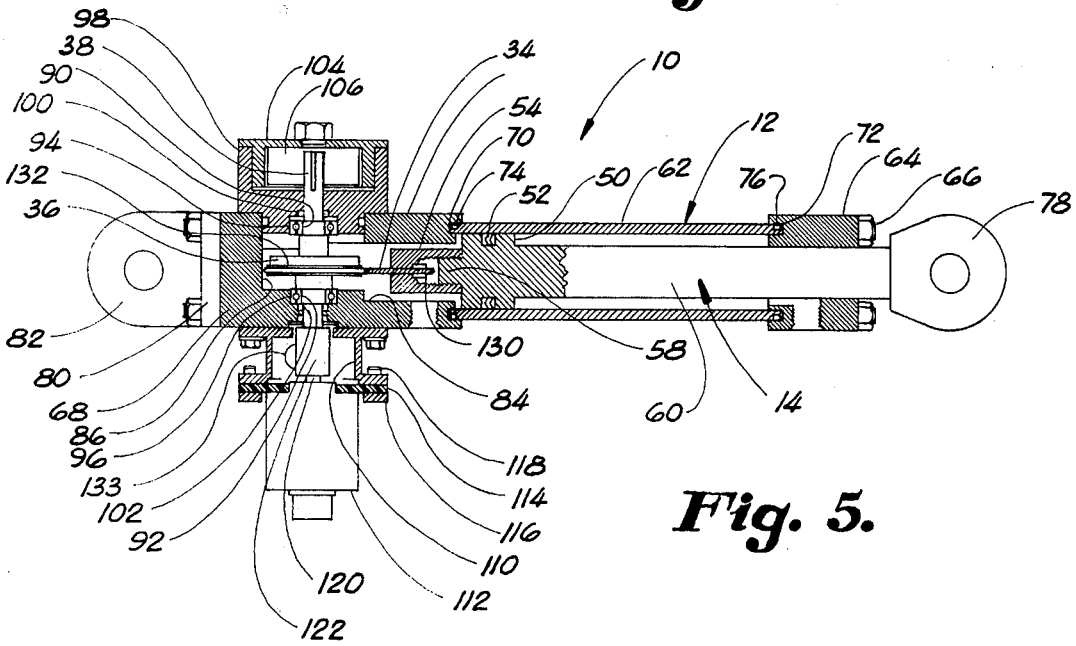
FIG. 5 is enlarged, vertical, sectional view taken along line 5—5 of FIG. 4.

The piston 14 (FIGS. 5 and 6) includes a grooved head 50 having a sealing ring 52 which is, in the present instant, a low friction slipper seal. A coupling cup 54 is secured by a pin 56 to a short rod portion 58 aligned with a piston rod 50 of the piston. The head is slidable in a sleeve 62 of the cylinder, and the piston rod 60 is slidable in an endblock 64 secured by tie rods 66 to housing block 68 with the sleeve extending into grooves 70 and 72 in the blocks and sealing against O-ring seals 74 and 76. The piston rod has an eye 78 for coupling the rod to the load 16 and an eye member 80 is bolted to the housing block and adapted to be bolted to a support bracket 81 (FIG. 1) of the infeed table. Eye portion 82 of the eye member 80 is centered relative to the piston rod and the eye 78. The housing block 68 has a bore 84 (FIG. 5) adapted to loosely receive the cup 54 and chordally intersecting transverse bore 86 in the housing block, the pulley 36 being positioned in the bore 86.

The shaft 38 (FIGS. 5 and 6) is journaled in bearings 90 and 92 mounted in sockets 94 and 96 formed in a boss of a spring holder 98 and the housing block 68. Seals 100 and 102 seal the shaft. A cupped cover 104 is bolted to the spring holder, and a coiled spring 106 is fastened at its outer end to the cover and at its inner end to the shaft. The spring urges the shaft in a counter-clockwise direction, as viewed in FIG. 6.

A tubular, flanged adaptor 110 (FIGS. 1 and 6) is bolted to the housing block 68, and an encoder transducer 112 is bolted to the outer flange of the adapter with a resilient, diaphragm like elastomeric disc 114 of the encoder clamped against the outer flange by a clamping ring 116 secured to the outer flange by capscrews 118. The transducer has a shaft 120 keyed to the shaft 38 by a coupling 122, and gives an electrical output pulse for each predetermined, small increment of rotation of the shaft 120. The transducer is of a well known commercially available encoder.

One end of the cable 34 is fastened to the cup 54 by a ferrule 130 (FIGS. 5 and 6) and extends through a bore in the cup. The other end of the cable is fixed to the pulley 36, with the portion of the cable on the pulley lying in a groove 132 in the pulley, and at a point on the pulley such that, when the piston 14 is in its extreme lefthand position, as viewed in FIGS. 5 and 6, almost a full circle of the cable is lying in the groove, that is, stored on the pulley. The pulley is of sufficient diameter that, when the piston is in its extreme extended position, there is still some of the cable stored on the pulley. The effective diameter of the pulley also is such that, for rotation of the pulley through a given angle, a predetermined number of pulses will be produced by the transducer. An access hole 133 sealed by a removable plug is provided in the housing 68. The pulley can also be of spiral groove construction to receive multiple wraps of feedback wire.

Figure 9:
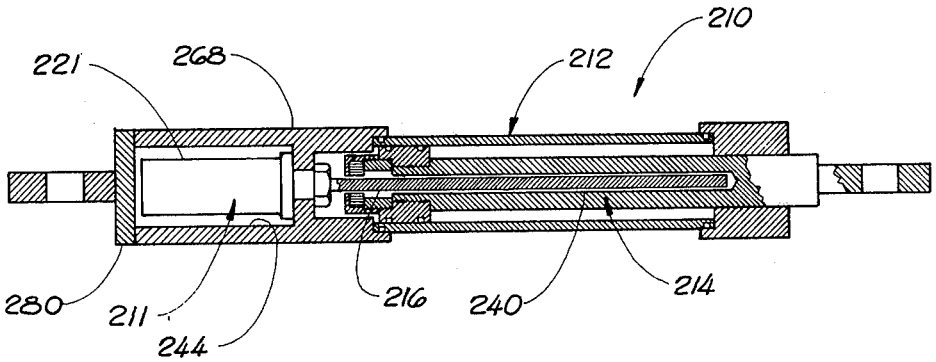
FIG. 9 is a longitudinal sectional view of the cylinder of FIG. 8.
Figure 8:
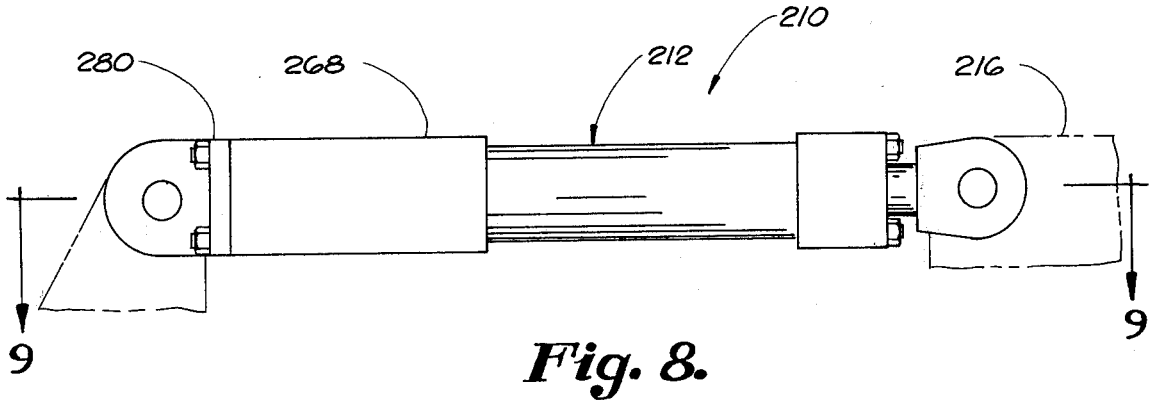
FIG. 8 is a elevation view of a cylinder positioning system forming an alternate embodiment of the invention.

Embodiment of FIGS. 8 and 9

Figure 4:
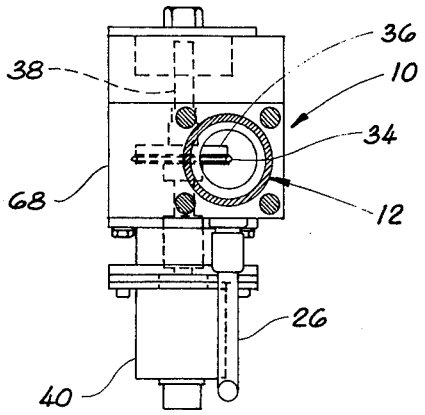
FIG. 4 is a vertical, sectional view taken along line 4—4 of FIG. 1.
Figure 3:
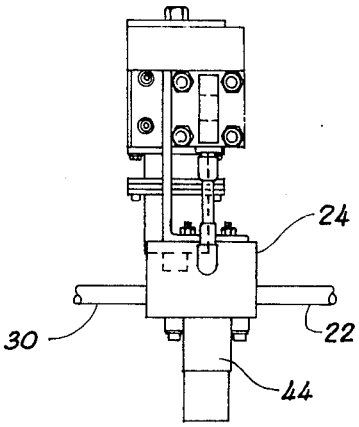
FIG. 3 is an end view taken along line 3—3 of FIG. 1.
Figure 2:
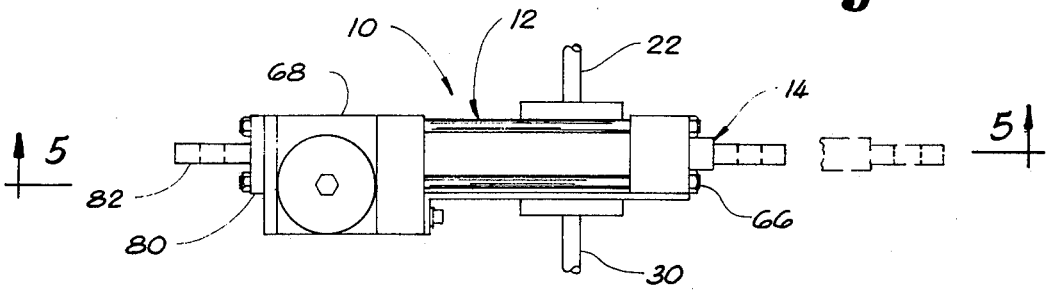
FIG. 2 is a top plan view taken along line 2—2 of FIG. 1.
Figure 1:
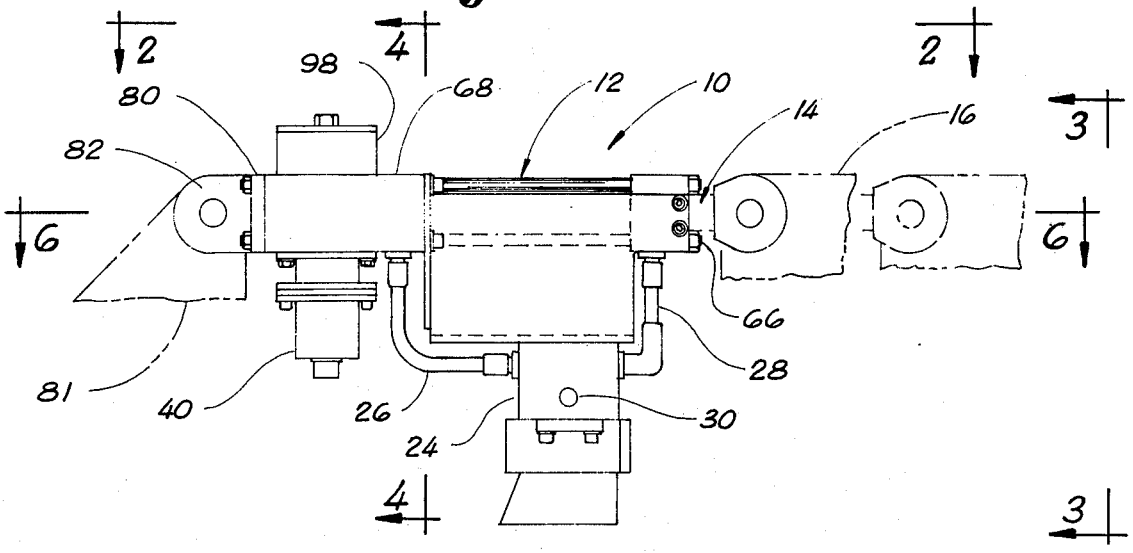
FIG. 1 is a fragmentary, side elevation view of a cylinder positioning system forming one embodiment of the invention.

A cylinder positioning system forming an alternate embodiment of the invention is like that of FIGS. 1 to 7 but, instead of having the rotary transducer 112, has a linear transducer 211. A cylinder drive 210 has a cylinder 212 and a piston 214 to drive a positioner 216. However, the piston 214 includes a second rod 216 slidable in a counterbore 240 in a linear housing block 268 and rigidly secured to linearly movable actuating member 220 of the transducer 211 which has a housing 221 fixed in counterbore 244 in the block 268. An eye member 280 is bolted to the housing block 268 and is secured to a support (now shown) like the support 81 (FIG. 1). Movement of the actuating member 220 with the piston 214 causes a change in the reluctance of the transducer 211, which is of a known and commercially available type. The transducer 211 is used with an analog or digital control circuit (not shown).

What is claimed is:

1. In a positioning system, a cylinder, piston means having a piston, a work piston rod at one end of the piston and coupling means at the other end of the piston, and block means sealed to a cylinder end closest to said one end of said piston housing block means sealed to the end of the cylinder closest to said other end of the piston, a cable having an end portion secured to the coupling means, a capstan pulley around which the cable extends, a rotary shaft mounting the pulley, a pair of bearing means in the housing block means mounting the shaft in a position in which the pulley is tangential to a line parallel to the centerline of the piston and spaced one-half the diameter of the cable from said centerline, a pair of seals in the housing block means journalling the shaft, a coil spring connected to the housing block means and one end portion of the shaft outside one of the seals, first port means at one end of the cylinder, second port means at the other end of the cylinder, and rotary transducer means mounted on the housing block means in a position at the other end of the shaft outside the other seal and coupled to the shaft, said housing block means including a housing block mounting one of the bearing means and one of the seals, and also including a spring housing means housing the spring means and the other bearing means and the other seal.

* * * * *